US007887158B2

(12) United States Patent
Yamashita

(10) Patent No.: US 7,887,158 B2
(45) Date of Patent: Feb. 15, 2011

(54) DROPLET EJECTING DEVICE

(75) Inventor: Takamaro Yamashita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 205 days.

(21) Appl. No.: 12/195,528

(22) Filed: Aug. 21, 2008

(65) Prior Publication Data

US 2009/0231386 A1 Sep. 17, 2009

(30) Foreign Application Priority Data

Mar. 17, 2008 (JP) ..... 2008-068319

(51) Int. Cl.
*B41J 2/165* (2006.01)
*B41J 2/215* (2006.01)

(52) U.S. Cl. ..... 347/30; 347/34; 347/83

(58) Field of Classification Search ..... 347/34, 347/30, 31, 35, 83
See application file for complete search history.

(56) References Cited

U.S. PATENT DOCUMENTS 5,298,926 A 3/1994 Fukushima et al.
5,904,351 A 5/1999 Masek et al.
2006/0221161 A1 10/2006 Hori

FOREIGN PATENT DOCUMENTS

| | | |
|---|---|---|
| JP | 63-160845 | 7/1988 |
| JP | 02026751 | 1/1990 |
| JP | 2-179761 | 7/1990 |
| JP | 4-083645 | 3/1992 |
| JP | 5-000518 | 1/1993 |
| JP | 2004-276381 | 10/2004 |
| JP | 2005059492 | 3/2005 |

*Primary Examiner*—Shih-wen Hsieh
(74) *Attorney, Agent, or Firm*—Fildes & Outland, P.C.

(57) ABSTRACT

A droplet ejecting device has a droplet ejecting head, a rotating member, a recovery unit, and a negative pressure generating unit. The rotating member is disposed so as to oppose a nozzle surface of the droplet ejecting head, and is a conveying body that conveys a recording medium. The recovery unit has a suction hole provided at a region of the rotating member on which the recording medium is not loaded, and recovers, from the suction hole, liquid that becomes a mist at a time when the droplets are ejected from the nozzles. The negative pressure generating unit generates negative pressure at the recovery unit.

12 Claims, 10 Drawing Sheets

20Y
20M
20C
20K
22Y
22M
22C
22K
26
26A
26B
30
32
34
40
42
46
48
50
54
56
58
62
64
E
P

DROPLET EJECTING DEVICE

CROSS-REFERENCE TO RELATED APPLICATION

This application is based on and claims priority under 35 USC 119 from Japanese Patent Application No. 2008-068319 filed Mar. 17, 2008.

BACKGROUND

1. Technical Field

The present invention relates to a droplet ejecting device.

2. Related Art

When forming an image on a recording medium by ejecting droplets from nozzles of a droplet ejecting head, there are cases in which minute droplets that are unnecessary are generated. These minute droplets do not land on the recording medium and become fog-like (a mist), and are recovered by a mist recovery unit (see, for example, Japanese Patent Application Laid-Open (JP-A) No. 2004-276381).

SUMMARY

In consideration of the above circumstances, the present invention provides a droplet ejecting device.

According to an aspect of the invention, there is provided a droplet ejecting device comprising: a droplet ejecting head having nozzles that eject droplets; a rotating member disposed so as to oppose a nozzle surface of the droplet ejecting head, and functioning as a conveying body that conveys a recording medium; a recovery unit having a suction hole provided at a region of the rotating member where the recording medium is not loaded, and recovering, from the suction hole, liquid that becomes a mist at a time when the droplets are ejected from the nozzles; and a negative pressure generating unit generating negative pressure at the recovery unit.

BRIEF DESCRIPTION OF THE DRAWINGS

Exemplary embodiments of the present invention will be described in detail based on the following figures, wherein.

DETAILED DESCRIPTION

Figure 1:
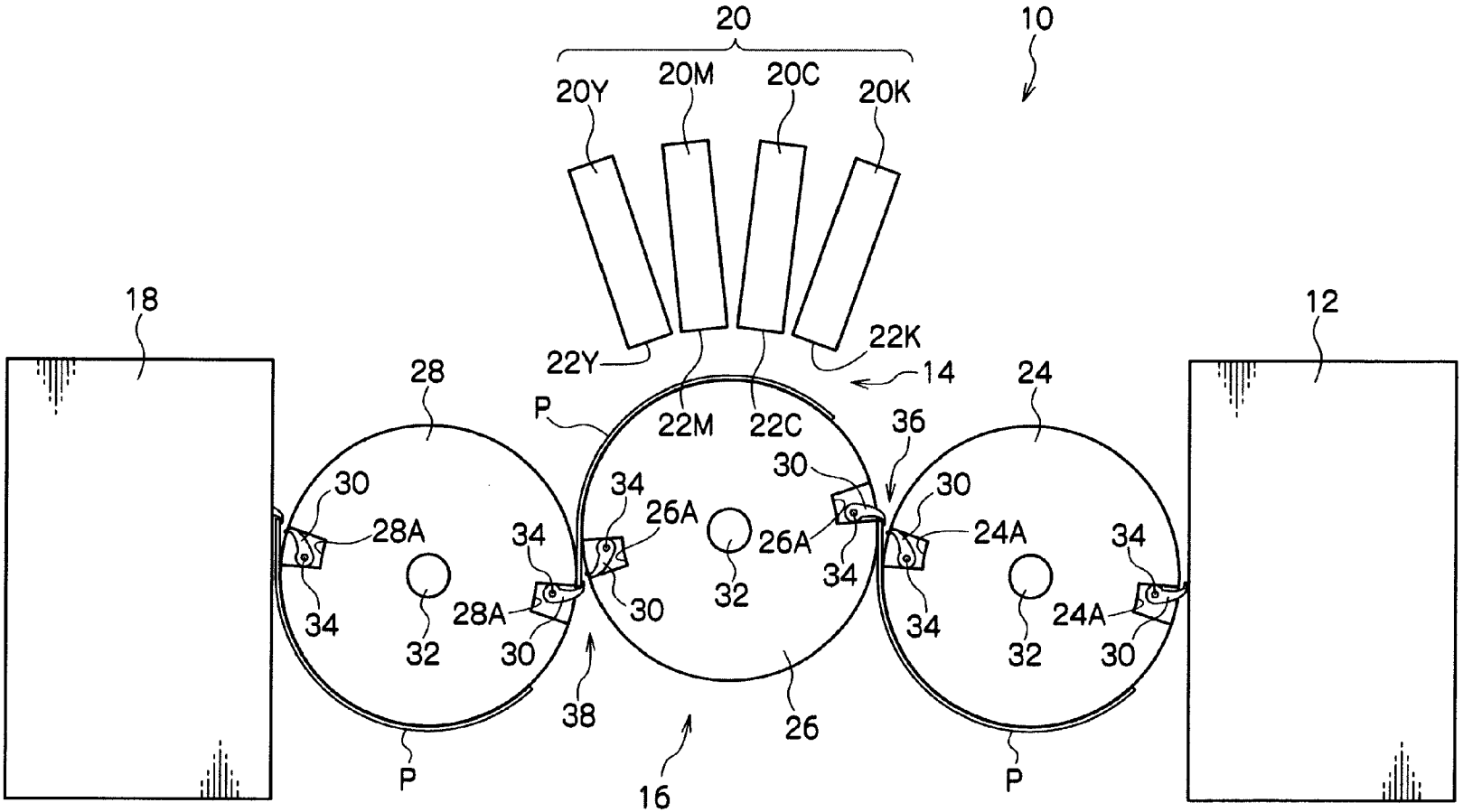
FIG. 1 is schematic side view showing the structure of an inkjet recording device.

Preferred exemplary embodiments of the present invention will be described in detail hereinafter on the basis of the examples illustrated in the drawings. The schematic structure of an inkjet recording device 10, which is an example of a droplet ejecting device relating to the present invention, is shown in FIG. 1. Accordingly, hereinafter, description is given with the droplet ejecting head being an inkjet recording head 20, and the recording medium on which an image is recorded by the droplet ejecting head being a recording sheet P.

As shown in FIG. 1, the inkjet recording device 10 has a sheet feeding section 12, an image recording section 14, a conveying unit 16, and a sheet ejecting section 18. The recording sheets P before images are recorded thereon are accommodated in the sheet feeding section 12. The image recording section 14 records an image on the recording sheet P supplied from the sheet feeding section 12. The conveying unit 16 conveys the recording sheet P to the image recording section 14. The sheet ejecting section 18 accommodates the recording sheet P after an image has been recorded thereon by the image recording section 14.

The image recording section 14 has the inkjet recording heads 20. The inkjet recording heads 20 have nozzle surfaces 22 at which plural nozzles (not shown) are formed. The nozzle surface 22 has a recordable region that is the same extent as or larger than the maximum width of the recording sheets P for which image recording at the inkjet recording device 10 is supposed (see FIGS. 6A, 6B).

The inkjet recording heads 20 are provided side-by-side in the order of yellow (Y), magenta (M), cyan (C) and black (K) from the downstream side in the conveying direction of the recording sheet P. The inkjet recording heads 20 are structured such that ink drops are ejected therefrom by a known means such as a thermal system, a piezoelectric system, or the like. Various types of inks, such as aqueous inks, oily inks, solvent-based inks, and the like can be used as the inks. Ink tanks (not shown) that supply inks to respective inkjet recording heads 20Y to 20K are provided at the inkjet recording device 10.

The conveying unit 16 has a pick-up drum 24, a conveying drum 26, and a feed-out drum 28. The pick-up drum 24 takes-out (picks-up) one-by-one the recording sheets P that are in the sheet feeding section 12. The conveying drum 26 conveys the recording sheet P to the inkjet recording heads 20 of the image recording section 14. The printing surface (surface) of the conveying drum 26 opposes the inkjet recording heads 20. The feed-out drum 28 feeds the recording sheet P, on which an image has been recorded, to the sheet ejecting section 18. Further, the pick-up drum 24, the conveying drum 26 and the feed-out drum 28 are respectively structured such that the recording sheet P is held at the peripheral surface thereof by an electrostatic attraction unit, or by a non-electrostatic attraction unit that utilizes suction, adhesion, or the like.

Grippers 30, that serve as holding units that nip and hold the conveying direction downstream side end portions of the recording sheets P, are provided at the pick-up drum 24, the conveying drum 26 and the feed-out drum 28. For example, two sets of the grippers 30 are provided at each of the drums 24, 26, 28. In this example, each of these three drums 24, 26, 28 is structured so as to be able to hold two of the recording sheets P at the peripheral surface of the drum. The grippers 30 are provided within concave portions 24A, 26A, 28A, two of which are formed at the peripheral surface of each of the drums 24, 26, 28, respectively.

Namely, rotating shafts 34 are placed pivotally at predetermined positions within the concave portions 24A, 26A, 28A of the respective drums 24, 26, 28, parallel to rotating shafts 32 of the drums 24, 26, 28. The plural grippers 30 are fixed to the rotating shafts 34 so as to be spaced apart from one another by predetermined intervals (e.g., uniform intervals) in the axial direction. Accordingly, due to the rotating shafts 34 rotating in both forward and reverse directions by unillustrated actuators, the grippers 30 rotate in both forward and reverse directions substantially along the peripheral directions of the respective drums 24, 26, 28, and nip/hold or release the conveying direction downstream side end portions of the recording sheets P.

The grippers 30 rotate such that the distal end portions thereof project-out slightly from the peripheral surfaces of the respective drums 24, 26, 28. Due thereto, at a transfer position 36 where the peripheral surface of the pick-up drum 24 and the peripheral surface of the conveying drum 26 oppose one another, the recording sheet P is transferred from the grippers 30 of the pick-up drum 24 to the grippers 30 of the conveying drum 26. Further, at a transfer position 38 where the peripheral surface of the conveying drum 26 and the peripheral surface of the feed-out drum 28 oppose one another, the recording sheet P is transferred from the grippers 30 of the conveying drum 26 to the grippers 30 of the feed-out drum 28.

Although not illustrated, a controller for the inkjet recording heads 20 and a system controller are provided at the inkjet recording device 10. The controller for the inkjet recording heads 20 determines the ejection timings of ink drops and the nozzles to be used in accordance with image signals, and applies driving signals to the nozzles. The system controller controls the overall operation of the inkjet recording device 10.

Figures 2A, 2B:
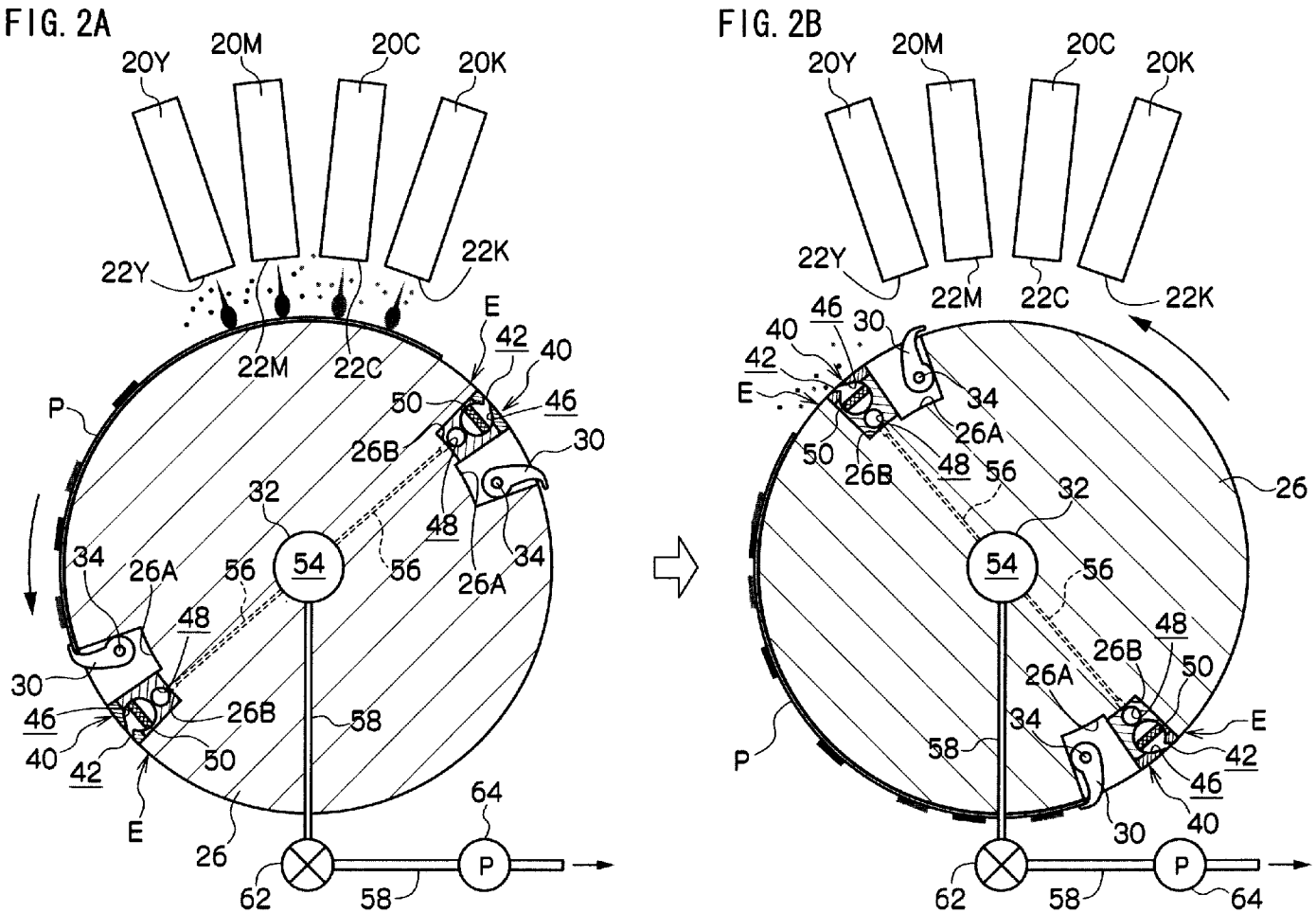
FIGS. 2A and 2B are schematic side sectional views showing the structure of a conveying drum that is equipped with recovery units.

As shown in FIG. 2A, the ink drops that are ejected from the inkjet recording heads 20 land on the printing surface of the recording sheet P held by the grippers 30 of the conveying drum 26, and an image is formed. At this time, there are cases in which, among the ink drops that are ejected from the inkjet recording heads 20, minute ink drops become a fog (mist) and float at the periphery of the conveying drum 26, without landing on the recording sheet P.

Due to the air flow generated by rotation of the conveying drum 26, the fog-like, unnecessary ink mist that floats (is distributed) at the periphery (above the peripheral surface) of the conveying drum 26 moves along the peripheral surface of the conveying drum 26 (spreads at the same locus as the peripheral surface of the conveying drum 26) at a speed that is slower than the rotating speed of the conveying drum 26. The recovery efficiency of the ink mist is high when the ink mist is recovered along this spreading distribution. Therefore, mist recovery units 40 that recover the ink mist are provided at the peripheral surface of the conveying drum 26 at predetermined regions E where the recording sheet P is not loaded.

Figure 3:
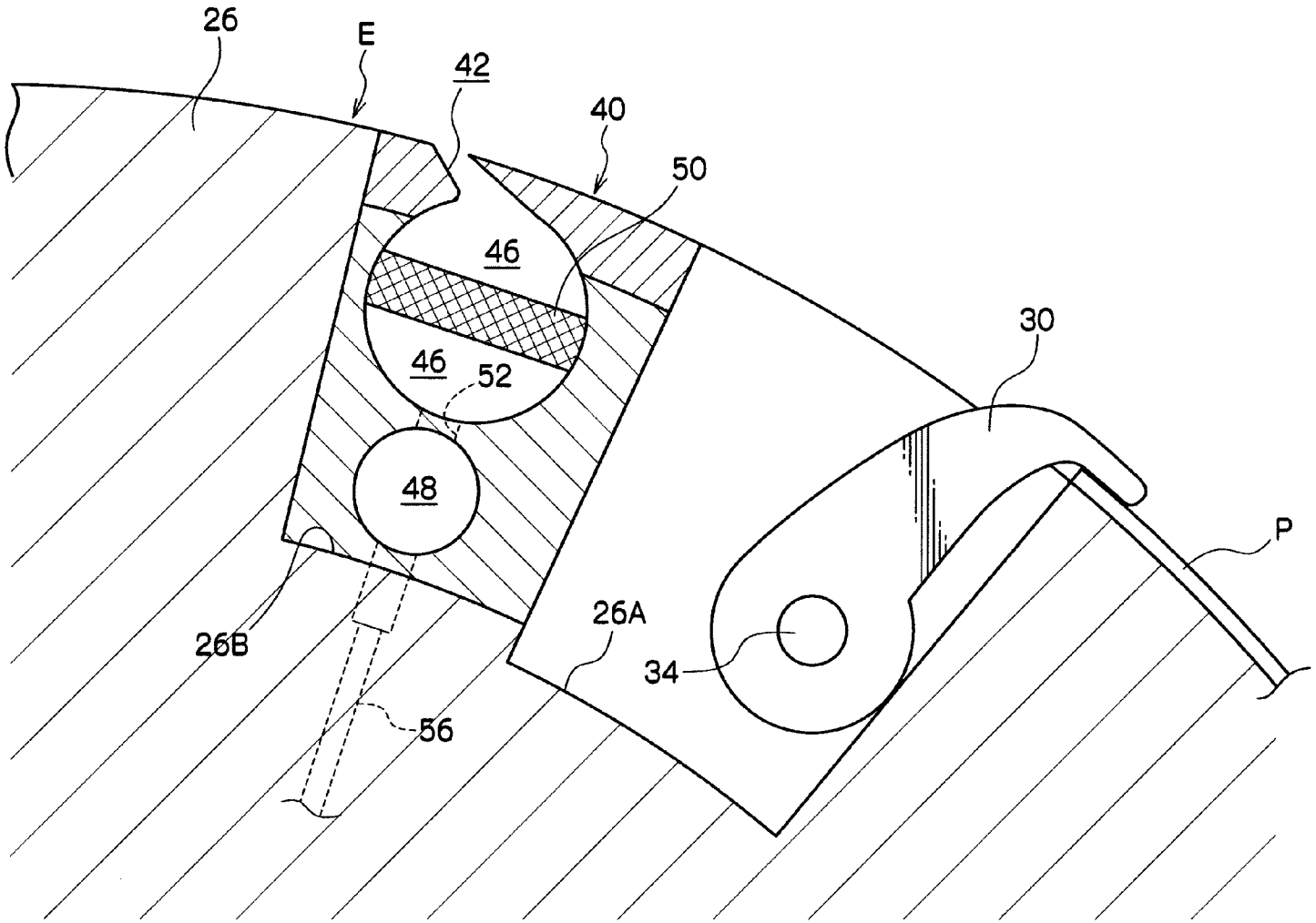
FIG. 3 is a schematic side sectional view showing the structure of the recovery unit.
Figure 4:
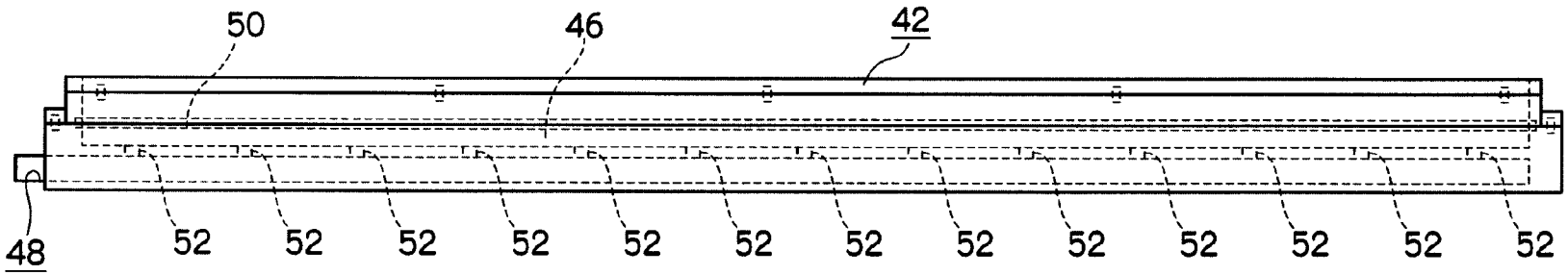
FIG. 4 is a schematic front view showing the structure of the recovery unit.

As shown in FIG. 2B, FIG. 3 and FIG. 4, the shape of the surface of the mist recovery unit 40 continues from the conveying direction upstream side end portion of the recording sheet P that is held by the grippers 30. The mist recovery unit 40 is provided within a concave portion 26B that is formed at the recording sheet P conveying direction downstream side of the other one set of the grippers 30 that hold the recording sheet P that follows, at the predetermined region E on which the recording sheet P is not loaded. The mist recovery unit 40 has a suction hole 42 for sucking and recovering the ink mist that floats (is distributed) in a vicinity of the peripheral surface of the conveying drum 26.

The suction hole 42 is provided on the locus of the recording sheet P that is conveyed by the conveying drum 26, so as to efficiently recover the ink mist that moves along the peripheral surface of the conveying drum 26 (spreads at the same locus as the peripheral surface of the conveying drum 26). The suction hole 42 is open at the peripheral surface, in a state of being inclined so as to be directed toward the recording sheet P conveying direction downstream side (the rotating direction) as seen in side sectional view.

A first reduced pressure chamber 46 is formed at the conveying drum 26 radial direction central side of the suction hole 42. A filter 50 is replaceably provided at the central portion of the first reduced pressure chamber 46, so as to block the suction hole 42. The filter 50 partitions the first reduced pressure chamber 46 into a space at the radiation direction outer side and a space at the radial direction central side of the conveying drum 26.

The radial direction central side space of the first reduced pressure chamber 46 is connected to a second reduced pressure chamber 48 via plural paths 52 (see FIG. 4). One end portion of a pipe 56 is connected to the second reduced pressure chamber 48. The other end portion of the pipe 56 is connected to a path 54 that is formed in the rotating shaft 32.

One end portion of a tube 58, that is provided at the exterior of the conveying drum 26, is connected to the path 54. A suction pump 64 serving as a negative pressure generating unit is connected to the other end portion of this tube 58. Further, a valve 62 is provided at the tube 58 between the path 54 and the suction pump 64.

Due thereto, the second reduced pressure chamber 48 and the first reduced pressure chamber 46 can be made to be negative pressure, and the ink mist is sucked from the suction hole 42 and captured and recovered at the filter 50. Note that the flow rate of the suction pump 64 can be set and changed appropriately by adjusting the valve 62 in accordance with the generated amount of the ink mist, the image coverage, the types of inks, and the like.

Figure 5:
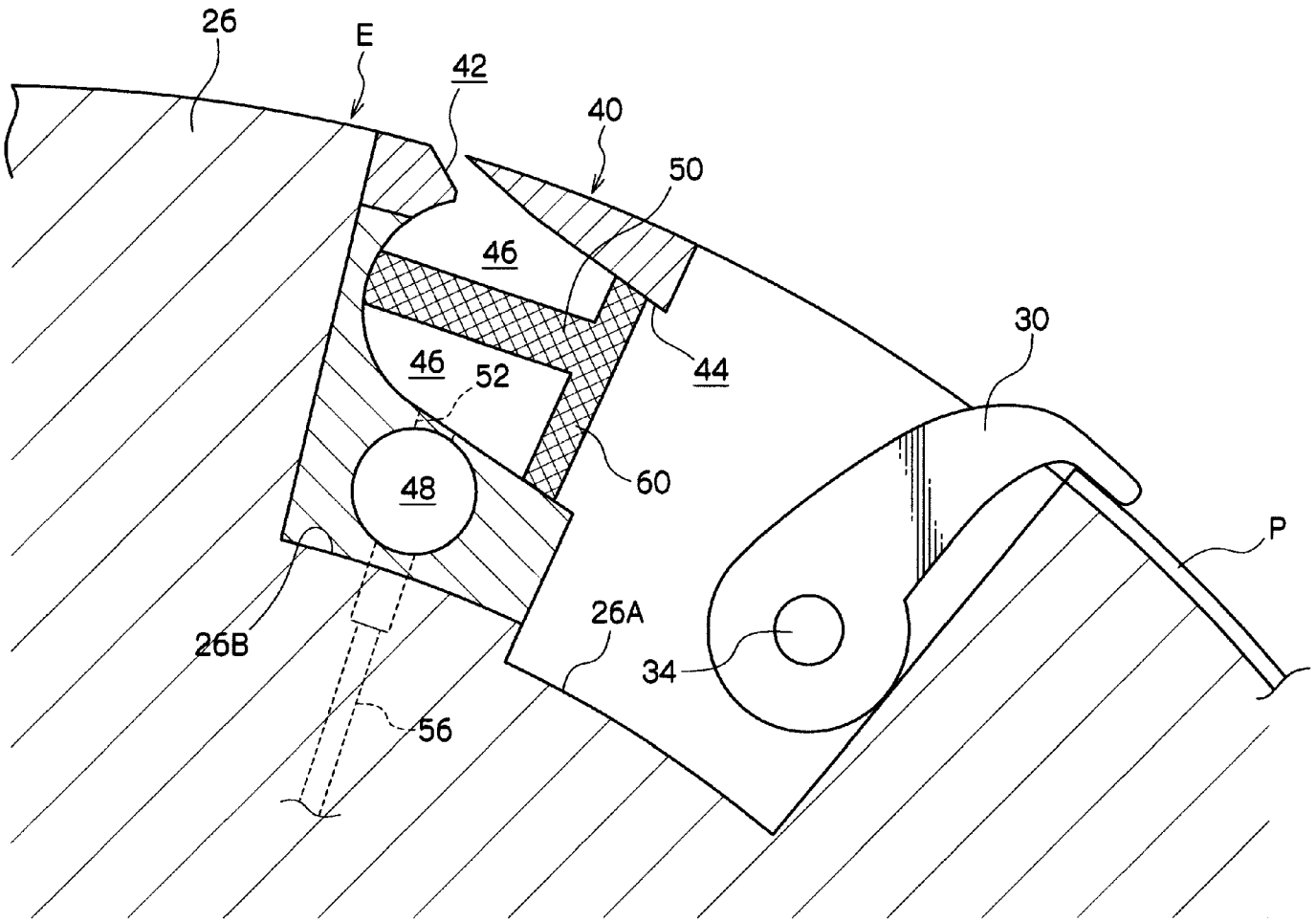
FIG. 5 is a schematic side sectional view showing the structure of another recovery unit.

In a case in which the mist recovery unit 40 is formed adjacent to the concave portion 26A of the grippers 30, as shown in FIG. 5, a suction hole 44 that opens toward the concave portion 26A may be formed at the first reduced pressure chamber 46, and a filter 60 that blocks the suction hole 44 may be replaceably disposed at the inner side thereof (the first reduced pressure chamber 46 side thereof). (In this case, the filter 50 and the filter 60 may be formed integrally.) Due thereto, the ink mist, that enters into the concave portion 26A and stays thereat and adheres thereto, also may be captured and recovered.

Figure 6A:
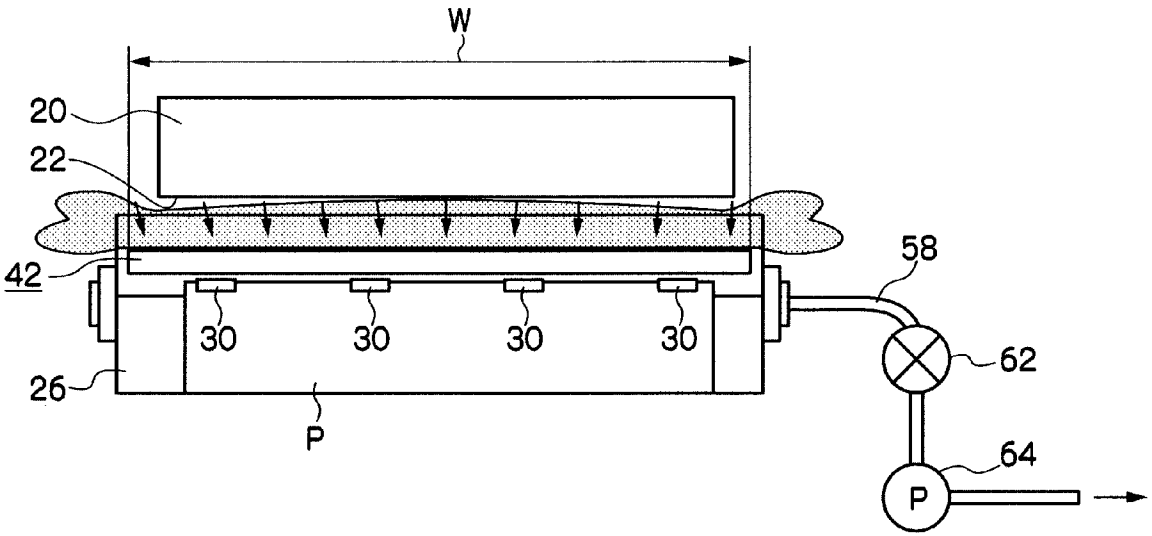
FIGS. 6A and 6B are schematic front views showing operation of a conveying drum that is equipped with the recovery unit.
Figure 6B:
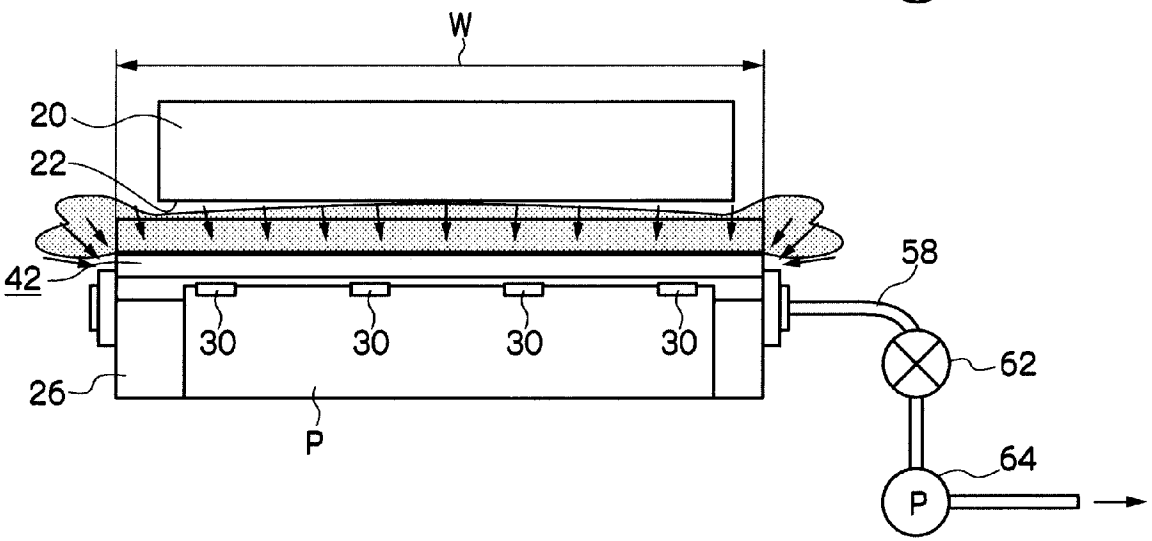

As shown in FIG. 6A, a width W of the suction hole 42 in the direction of the rotational axis of the conveying drum 26 is made to be greater than or equal to the width of the image forming region (the width of the inkjet recording head 20) in the direction of the rotational axis of the conveying drum 26, that is the range of generation of the ink mist. In a case in which the region over which the ink mist is generated and spreads is large, the recovery range of the ink mist is broadened by providing the suction hole 42 to include the both end portions in the direction of the rotational axis of the conveying drum 26, as shown in FIG. 6B.

Figure 7A:
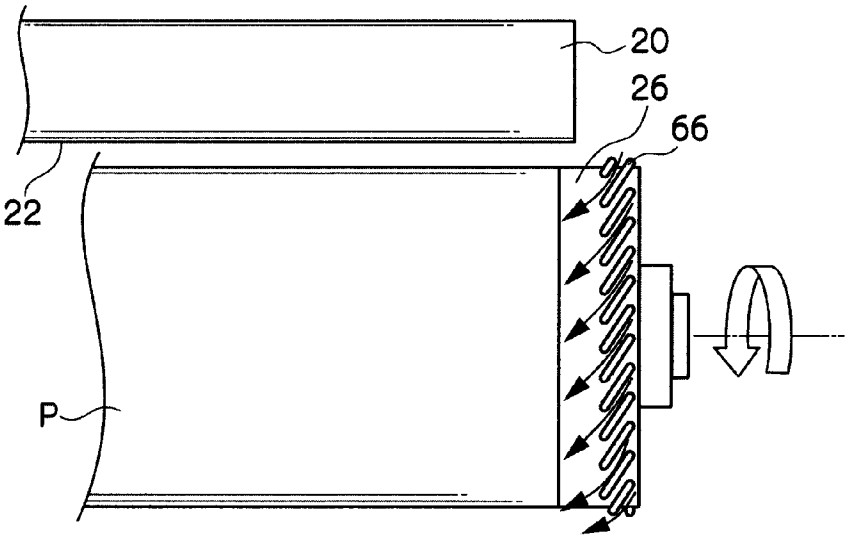
FIGS. 7A and 7B are schematic front views showing operation of a conveying drum that is equipped with a flow adjusting unit.
Figure 7B:
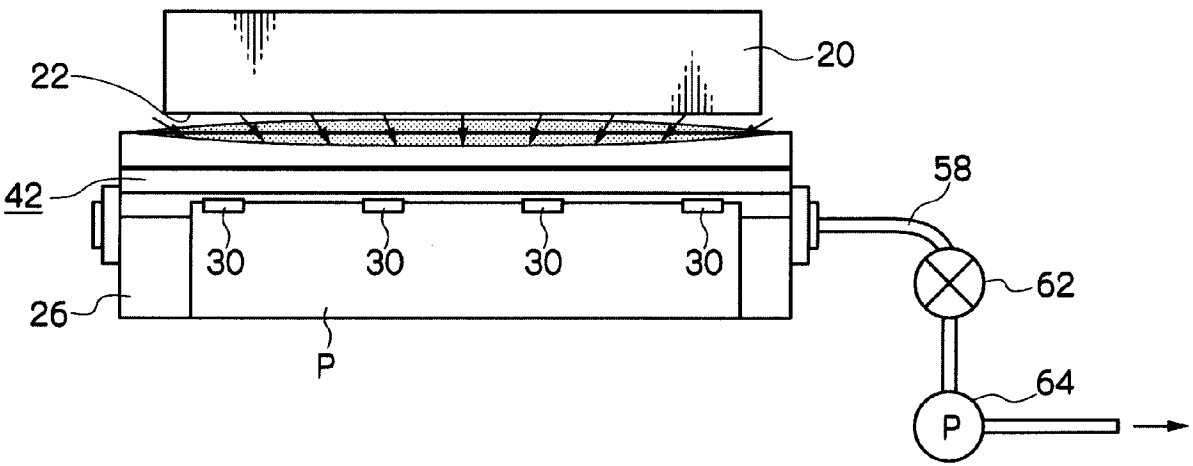

Note that the suction hole 42 may be formed integrally at the entire width in the direction of the rotational axis of the conveying drum 26. Or, the suction holes 42 may be provided at both end portions in the direction of the rotational axis of the conveying drum 26, independently of the suction hole 42 shown in FIG. 6A. Further, as shown in FIGS. 7A and 7B, plural ribs 66 may be formed at both end portions in the direction of the rotational axis of the conveying drum 26. The ribs 66 function as flow adjusting units that generate airflows that are directed toward the central portion in the direction of the rotational axis of the conveying drum 26, at the time when the rotating drum 26 is driven and rotated.

The ribs 66 are preferably formed at the both end portions in the direction of the rotational axis of the conveying drum 26, at least at the conveying direction upstream side from the substantially central portion in the recording sheet P conveying direction. In a case in which the suction holes 42 are not provided at the both end portions in the direction of the rotational axis of the conveying drum 26, it is preferable to form the ribs 66 also at positions at the outer sides of the suction hole 42. Note that, in a case in which the suction hole 42 is provided so as to include the both end portions in the direction of the rotational axis of the conveying drum 26, it is preferable that the ribs 66 be formed to positions that are adjacent to the suction hole 42.

Operation of the inkjet recording device 10 of the above-described structure will be described next. The recording sheet P, that is picked-up and held one-by-one from the sheet feeding section 12 by the grippers 30 of the pick-up drum 24, is conveyed while being stuck to the peripheral surface of the pick-up drum 24, and, at the transfer position 36, is transferred from the grippers 30 of the pick-up drum 24 to the grippers 30 of the conveying drum 26.

While being stuck to the conveying drum 26, the recording sheet P that is held by the grippers 30 of the conveying drum 26 is conveyed to the image recording position of the inkjet recording heads 20, and an image is formed on the printing surface thereof by ink drops ejected from the inkjet recording heads 20. At this time, the minute ink drops that do not land on the printing surface of the recording sheet P become a fog-like, unnecessary ink mist. Due to the air flow generated by rotation of the conveying drum 26, the ink mist moves along the peripheral surface of the conveying drum 26 in the direction of rotation at a slower speed than the rotational speed of the conveying drum 26 while floating at the peripheral surface (the ink mist spreads at the same locus as the peripheral surface of the conveying drum 26).

Here, the suction hole 42 is provided at the predetermined region E of the conveying drum 26 on which the recording sheet P is not loaded, in a vicinity of the upstream side end portion in the conveying direction of the recording sheet P, i.e., at the recording sheet P conveying direction downstream side of the grippers 30 that hold the recording sheet P that follows. Further, the suction pump 64 is connected to the suction hole 42 via the first reduced pressure chamber 46, the path 52, the second reduced pressure chamber 48, the pipe 56, the path 54, the tube 58 and the valve 62, and negative pressure is generated by the suction pump 64.

Accordingly, as shown in FIG. 6A, the ink mist that floats (spreads and is distributed) at the periphery (above the peripheral surface) of the conveying drum 26 is sucked by the suction hole 42 in an environment in which it is difficult for turbulent flow to arise, and is captured and recovered by the filter 50 provided within the first reduced pressure chamber 46. Note that, in a case in which the suction hole 42 is provided over the both end portions in the direction of the rotational axis of the conveying drum 26 (is provided so as to include the both end portions in the direction of the rotational axis) as shown in FIG. 6B, the ink mist that spreads toward the outer sides from the both end portions in the direction of the rotational axis of the conveying drum 26 also may be sucked by the suction hole 42 and captured and recovered by the filter 50 provided within the first reduced pressure chamber 46.

Further, as shown in FIG. 7A, the plural ribs 66, that generate air flows toward the central portion in the direction of the rotational axis of the conveying drum 26 by the rotation of the conveying drum 26, are formed at the both end portions in the direction of the rotational axis of the conveying drum 26. In this case, as shown in FIG. 7B, the ink mist that floats (spreads and is distributed) at the periphery (above the peripheral surface) of the conveying drum 26 is, while being brought toward the central portion in the direction of the rotational axis of the conveying drum 26, sucked by the suction hole 42, and is captured and recovered by the filter 50 provided within the first reduced pressure chamber 46.

On the other hand, the recording sheet P on whose printing surface an image has been formed is, at the transfer position 38, transferred from the grippers 30 of the conveying drum 26 to the grippers 30 of the feed-out drum 28. Then, the recording sheet P that is held by the grippers 30 of the feed-out drum 28 is conveyed while being stuck to the feed-out drum 28, and is fed to the sheet ejecting section 18. In this way, the series of image formation ends.

Figure 8:
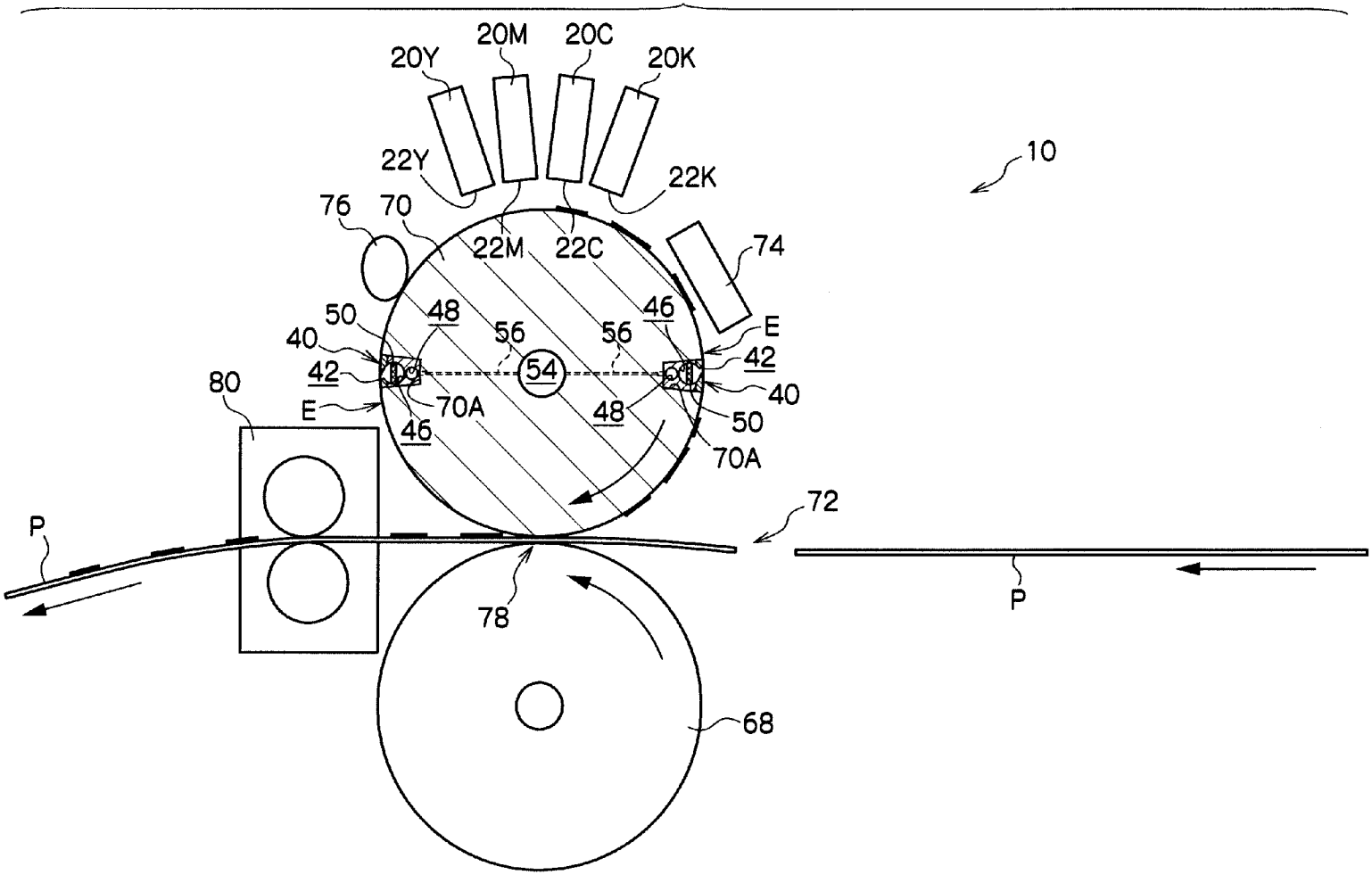
FIG. 8 is a schematic side sectional view showing the structure of a modified example of an inkjet recording device.

A modified example of the inkjet recording device 10 will be described next. Note that regions that are the same as those of the above-described example are denoted by the same reference numerals, and detailed description thereof (including description of the operation thereof) is omitted. As shown in FIG. 8, the inkjet recording device 10 of this modified example is provided with an intermediate transfer drum 70 that serves as an intermediate transfer medium (body) and that is disposed so as to oppose a secondary transfer drum 68 with a conveying path 72 of the recording sheet P therebetween.

The inkjet recording heads 20, a drying unit 74, the secondary transfer drum 68 and a cleaning unit 76 are disposed at the periphery of the intermediate transfer drum 70 from the upstream side in the rotating direction of the intermediate transfer drum 70. At a secondary transfer position 78 where the recording sheet P is supported by the secondary transfer drum 68, the image, that has been primarily transferred onto the intermediate transfer drum 70, is secondarily transferred onto the printing surface of the recording sheet P.

Then, at the recording sheet P on which the image is secondarily transferred, the secondarily-transferred image is fixed by a fixing unit 80 that is provided on the conveying path 72 at the recording sheet P conveying direction downstream side of the secondary transfer position 78. Note that the drying unit 74 applies warm air to the image that has been primarily transferred on the intermediate transfer drum 70, and evaporates and removes unnecessary solvent. The cleaning unit 76 removes the ink and the like that remains on the peripheral surface of the intermediate transfer drum 70 without being secondarily transferred onto the recording sheet P.

In the same way as in the above-described example, the mist recovery units 40 are provided at the intermediate transfer drum 70 of the inkjet recording device 10 having this structure. Namely, the mist recovery unit 40 is provided within a concave portion 70A that is formed in the peripheral surface of the intermediate transfer drum 70. The suction hole 42 is provided at the predetermined region E (on the locus of the image forming region) at the rotating direction upstream side, whose surface shape continues from the image forming region of the intermediate transfer drum 70. Further, at this suction hole 42, negative pressure is generated by a structure that is similar to that of the above-described example.

Accordingly, in the same way as in the above-described example, among the ink drops that are ejected from the inkjet recording heads 20, the unnecessary ink mist that has become a fog without landing on the peripheral surface of the intermediate transfer drum 70 (the primary transfer surface) is sucked by the suction hole 42 and is captured and recovered by the filter 50 provided in the first reduced pressure chamber 46. Note that the structure and the operation of the suction hole 42 being provided so as to include the both end portions in the direction of the rotational axis of the intermediate transfer drum 70, and the structure and the operation of the ribs 66 being formed at the both end portions in the direction of the rotational axis of the intermediate transfer drum 70, are similar to those of the above-described example, and therefore, description thereof is omitted.

Although an example and a modified example relating to the present exemplary embodiment have been described above, the above-described flow adjusting unit is not limited to the illustrated ribs 66. It suffices for the flow adjusting unit to be a structure that projects out from the peripheral surface at the both end portions in the direction of the rotational axis of the conveying drum 26 or the intermediate transfer drum 70, and that, as the conveying drum 26 or the intermediate transfer drum 70 rotates, generates air flows that are directed toward the central portion in the direction of the rotational axis. Accordingly, the flow adjusting unit may be a structure such as fins (not shown) for example.

The surface shape on the conveying drum 26 from the region where the recording sheet P is held to the region where the suction hole 42 is provided, and the surface shape on the intermediate transfer drum 70 from the image forming region to the region where the suction hole 42 is provided, preferably are smoothly continuous (are on the same curve or the same plane), from the standpoint of suppressing the generation of turbulent flow.

However, there may be steps, or protrusions and indentations, at the surface shape, provided that they are of an extent that does not affect the recovery of the ink mist. Further, it is preferable that the suction hole 42 be provided at greater than or equal to the width of the image forming region in the direction of the rotational axis of the conveying drum 26 or the intermediate transfer drum 70. If the suction hole 42 has a suctioning function of sucking the entire width of the image forming region, the suction hole 42 may be provided over a width that is slightly smaller than the width of the image forming region.

Figure 9:
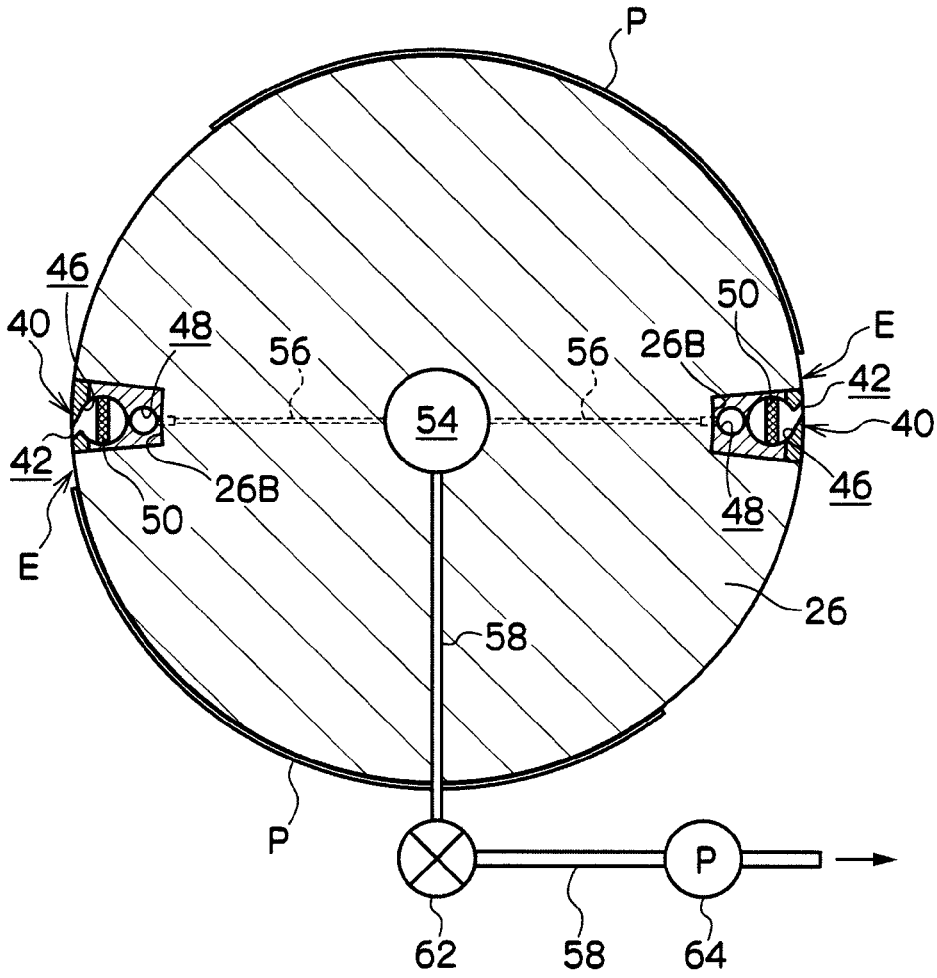
FIG. 9 is a schematic side sectional view showing the relative positions of recording media and the recovery units when the recording media are large.
Figure 10:
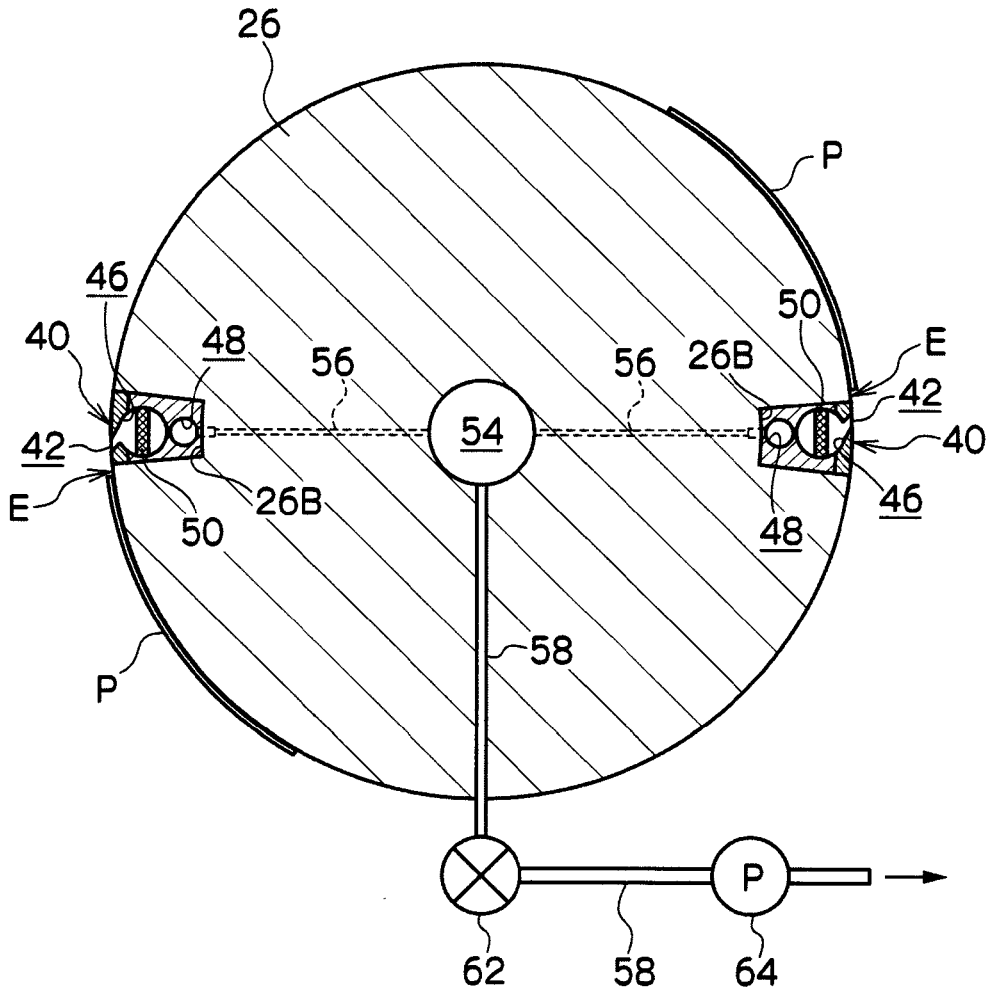
FIG. 10 is a schematic side sectional view showing the relative positions of recording media and the recovery units when the recording media are small.

Further, the grippers 30 are provided at the conveying drum 26 in the above-described exemplary embodiment. As shown in FIG. 9 and FIG. 10, in a case in which the recording sheet P is electrostatically attracted to the conveying drum 26 at which the grippers 30 are not provided, the conveying drum 26 may be structured such that the position of this electrostatic attraction (the relative interval between the mist recovery unit 40 and the upstream side end portion in the conveying direction of the recording sheet P) can be changed arbitrarily.

With such a structure, the mist recovery unit 40 may be disposed relatively at a near position of the conveying drum 26 that is continuous from the conveying direction upstream side end portion of the recording sheet P (may be disposed such that, in plan view, there is hardly any interval between the suction hole 42 and the conveying direction upstream side end portion of the recording sheet P). Therefore, changes in the size of the recording sheet P may be addressed without deteriorating the efficiency of recovering the ink mist.

Namely, even if the size of the recording sheet P is changed, the ink mist that floats (spreads and is distributed) at the periphery (above the peripheral surface) of the conveying drum 26 is, at a position that is nearer to the region where the ink mist is generated, sucked efficiently by the suction hole 42 in an environment in which it is difficult for turbulent flow to arise, and captured and recovered by the filter 50.

Although not illustrated, the grippers 30 and the suction holes 42 provided at the peripheral surface of the conveying drum 26 in the above-described examples may be structured such that the positions thereof can be changed with respect to one another. Namely, the peripheral surface that includes the concave portion 26A at which the grippers 30 are provided, and the peripheral surface that includes the concave portion 26B at which the suction hole 42 is provided, may be formed in the shapes of the teeth of a comb that mesh with one another, and the distance therebetween may be changed (these peripheral surfaces may be made to approach one another or move away from one another) within a range in which the meshing of the comb-teeth shapes is not cancelled.

Further, in the above-described examples, the conveying unit 16 is structured by the pick-up drum 24, the conveying drum 26 and the feed-out drum 28. Generally, in a case in which the conveying drum 26 is used, the accuracy of the surface positions is high and wrinkles do not form at the surface, as compared with a case in which a conveying belt (not shown) is used. For these and other reasons, in a case in which the conveying drum 26 is used, there are few fluctuations in the distance between the nozzles surfaces 22 and the surface of the recording sheet P, and it is difficult for turbulent flow at the surface of the conveying drum 26 to arise. Thus, it is difficult for the ink mist to spread, which is more suitable in terms of recovering the ink mist. Even if the conveying unit 16 is structured by a conveying belt, the present invention can be applied similarly.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to are suited to the particular use contemplated. It is intended that the scope of the invention be defined by the following claims and their equivalents.

What is claimed is:

1. A droplet ejecting device comprising:

a droplet ejecting head having nozzles that eject droplets;

a rotating member disposed so as to oppose a nozzle surface of the droplet ejecting head, and functioning as a conveying body that conveys a recording medium;

a recovery unit having a suction hole which has an opening provided at a region of the rotating member where the recording medium is not loaded, the opening being inclined so as to be directed toward a rotating direction of the rotating member and recovering, from the suction hole, liquid that becomes a mist at a time when the droplets are ejected from the nozzles; and a negative pressure generating unit generating negative pressure at the recovery unit.

2. The droplet ejecting device of claim 1, wherein the rotating member includes a drum.

3. The droplet ejecting device of claim 2, wherein the rotating member has a holding unit that nips an end of the recording medium and holds the recording medium, and the recovery unit has a second suction hole which opens to a concave portion that is formed in the rotating member for providing the holding unit, so as to be able to also recover the misty liquid that stays within the concave portion.

4. The droplet ejecting device of claim 1, wherein the suction hole is provided on a locus of the recording medium at a time when the rotating member rotates.

5. The droplet ejecting device of claim 4, wherein the suction hole is structured such that a relative position of the suction hole with respect to a conveying direction upstream side end of the recording medium can be changed in accordance with a size of the recording medium.

6. The droplet ejecting device of claim 1, wherein the suction hole is provided at a region, at a conveying direction upstream side of the recording medium, where a surface shape continues from a region of the rotating member on which the recording medium is loaded.

7. The droplet ejecting device of claim 6, wherein the suction hole is structured such that a relative position of the suction hole with respect to a conveying direction upstream side end of the recording medium can be changed in accordance with a size of the recording medium.

8. The droplet ejecting device of claim 1, wherein the suction hole is provided so as to extend over both end portions in a direction of a rotational axis of the rotating member.

9. The droplet ejecting device of claim 1, further comprising, at both end portions in a direction of a rotational axis of the rotating member, a flow adjusting unit that generates air flows that are directed toward a central portion in the direction of the rotational axis of the rotating member, at a time when the rotating member is driven and rotated.

10. The droplet ejecting device of claim 9, wherein the flow adjusting unit includes a plurality of ribs that are provided at the both end portions in the direction of the rotational axis of the rotating member.

11. The droplet ejecting device of claim 1, wherein the recovery unit has a filter that is provided further toward a radial direction central side of the rotating member than the suction hole so as to block the suction hole, and that captures the misty liquid.

12. The droplet ejecting device of claim 1, wherein the recovery unit is connected to the negative pressure generating unit via a path that is provided at a rotating shaft of the rotating member.

* * * * *